US006892436B2

(12) United States Patent
Yamaguchi et al.

(10) Patent No.: US 6,892,436 B2
(45) Date of Patent: May 17, 2005

(54) METHOD OF HOLDING A DRIED HONEYCOMB STRUCTURE

(75) Inventors: Satoru Yamaguchi, Anjyo (JP); Hiromi Katou, Kuwana (JP); Yasushi Miyamura, Kuwana (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/186,726

(22) Filed: Jul. 2, 2002

(65) Prior Publication Data

US 2003/0014856 A1 Jan. 23, 2003

(30) Foreign Application Priority Data

Jul. 4, 2001 (JP) ..... 2001-203912

(51) Int. Cl.[7] ..... B23Q 7/00

(52) U.S. Cl. ..... 29/559; 29/283; 29/890; 901/31; 428/593; 428/116; 428/118; 269/86; 269/257

(58) Field of Search ..... 29/559, 243, 283, 29/890; 901/31, 39; 428/593, 116, 118; 502/527.19, 439; 422/168; 269/86, 151, 164, 257, 258, 909

(56) References Cited

U.S. PATENT DOCUMENTS 4,134,578 A * 1/1979 Stanley ..... 269/249
4,428,710 A * 1/1984 Grisebach et al. ..... 414/590
4,428,758 A * 1/1984 Montierth ..... 55/523
4,505,636 A * 3/1985 Sugino et al. ..... 414/736
5,108,140 A * 4/1992 Bartholet ..... 294/106
5,178,431 A * 1/1993 Voellmer ..... 294/86.4
5,570,920 A * 11/1996 Crisman et al. ..... 294/111
5,836,633 A * 11/1998 Svensson ..... 294/88
5,997,984 A * 12/1999 Koike et al. ..... 428/116
6,159,578 A 12/2000 Ichikawa
6,505,870 B1 * 1/2003 Laliberte et al. ..... 294/106
6,572,164 B2 * 6/2003 Murakami et al. ..... 294/1.1
6,592,324 B2 * 7/2003 Downs et al. ..... 414/741

FOREIGN PATENT DOCUMENTS

EP 355866 A2 * 2/1990 ..... B25J/9/10
JP 02106296 A * 4/1990 ..... B25J/15/08
JP 02190282 A * 7/1990 ..... B25J/15/04
JP 11-320723 11/1999

* cited by examiner

*Primary Examiner*—Jermie E. Cozart
(74) *Attorney, Agent, or Firm*—Nixon & Vanderhye PC

(57) ABSTRACT

A method of holding a dried honeycomb structure 8, which is a honeycomb structure after a drying process and before a firing process, when a ceramic honeycomb structure in which bulkheads forming a number of cells are disposed in the form of a honeycomb is manufactured with a manufacturing method including a extruding process, the drying process, and the firing process. A chuck 1 having a plurality of claws 10 is used and the plurality of claws 10 are allowed to come into contact with an outer periphery 89 of the dried honeycomb structure 8 so that the direction of the pressure F applied to the dried honeycomb structure 8 by the claws is substantially parallel with the bulkheads 81.

14 Claims, 5 Drawing Sheets

METHOD OF HOLDING A DRIED HONEYCOMB STRUCTURE

BACKGROUND OF THE INVENTION

1. Field of the Invention

The present invention relates to a method of holding a dried honeycomb structure in the process of manufacturing a ceramic honeycomb structure.

2. Description of the Related Art

A ceramic honeycomb structure has been applied to, for example, a filter for purifying the gas exhausted from an internal combustion engine of a vehicle. In recent years, it is required to reduce the thickness of the bulkheads of this honeycomb structure for the purpose of increasing the surface area, etc.

When the honeycomb structure is manufactured, ceramic material is mixed and kneaded and then the kneaded ceramic material is extruded in the form of honeycomb to obtain a honeycomb structure, and then the honeycomb structure is dried and then fired.

As the honeycomb structure is very brittle particularly after the drying and before the firing, the bulkheads may be chipped and/or crushed when the honeycomb structure is held. In particular, due to the progress of thinning the bulkheads, there has been a high incidence of chipping and/or crushing, and thus the conventional holding method is unable to cope with such situation.

SUMMARY OF THE INVENTION

It is, therefore, an object of the present invention to provide a method, of holding a honeycomb structure, by which it can be prevented that the bulkheads of the honeycomb structure are chipped and/or crushed, in the process of manufacturing the honeycomb structure.

In a first aspect, the present invention is a method of holding a dried honeycomb structure, which is a honeycomb structure after a drying process and before a firing process, when the ceramic honeycomb structure, in which bulkheads forming a number of cells are disposed in the form of a honeycomb, is manufactured with a manufacturing method comprising a extruding process, the drying process, and the firing process; wherein a chuck having a plurality of claws is used and the plurality of claws are allowed to come into contact with the outer periphery of the dried honeycomb structure so that the direction of the pressure applied to the honeycomb structure by the claws is substantially parallel with the bulkheads.

In the present invention, the chuck is used and the dried honeycomb structure is held by the claws of the chuck. The plurality of claws are allowed to come into contact with the outer periphery of the dried honeycomb structure so that the direction of the pressure applied to the dried honeycomb structure by the claws is substantially parallel with said bulkheads.

The dried honeycomb structure has the highest strength in the direction in substantially parallel with the bulkheads. Therefore, when the chuck holds the dried honeycomb structure, which is apt to be chipped or crushed, the rigidity to the pressure by the chuck is substantially largest, and thereby chipping and crushing can be restricted. Thus, even if the total rigidity of the dried honeycomb structure decreases because of the thin bulkheads, chipping and crushing can be restricted.

This advantage of the present invention is effective for any form of the cells (lattices) constituted by the bulkheads.

In a second aspect of the present invention, the bulkheads are disposed so as to constitute the cells having a quadrangular shape, and the angle between the bulkheads and the direction of the pressure applied by the claws is preferably in the range of ±35° with reference to the direction parallel with the bulkheads and is more preferably in the range of ±15°. When the angle is more than ±35°, the effect of restricting damage such as chipping and crushing of the bulkheads decreases, and damage such as chipping and crushing may thus increase.

In a third aspect of the present invention, the bulkheads are disposed so as to constitute the cells having a hexagonal shape, and the angle between the bulkheads and the direction of the pressure applied by the claws is preferably in the range of ±20° with reference to the direction parallel with the bulkheads and is more preferably in the range of ±10°. In this case, when the angle is more than ±20°, the effect of restricting damage such as chipping and crushing of the bulkheads decreases, and damage such as chipping and crushing may thus increase.

In a fourth aspect of the present invention, the bulkheads are disposed so as to constitute the cells having a triangular shape, and the angle between the bulkheads and the direction of the pressure applied by the claws is preferably in the range of ±20° with reference to the direction parallel with the bulkheads and is more preferably in the range of ±10°. In this case, when the angle is more than ±20°, the effect of restricting damage such as chipping and crushing of the bulkheads decreases, and damage such as chipping and crushing may thus increase.

In a fifth aspect of the present invention, the thickness of the bulkheads is preferably 150 $\mu$m or less and more preferably 100 $\mu$m or less and, when the thickness of the bulkheads is 100 $\mu$m or less, the rigidity of the dried honeycomb structure particularly decreases, and the advantage of the above holding method may thus be effective.

In a sixth aspect of the present invention, the chuck is disposed on an arm of a robot for moving the chuck, and the relative position of the chuck with respect to the dried honeycomb structure is preferably adjusted by moving the chuck. In this aspect, for example, in a combination of the position sensor for detecting the lattice direction of the dried honeycomb structure and the control unit of the robot, the relative position of the chuck with respect to the dried honeycomb structure can be easily adjusted automatically, and thereby the contact positions of the claws can be controlled accurately.

In a seventh aspect of the present invention, the relative position of the chuck with respect to the dried honeycomb structure is adjusted by moving the dried honeycomb structure, and the optimum relative position of the chuck with respect to the dried honeycomb structure can be controlled, for example, by turning the base on which the dried honeycomb structure is placed.

The position where the claws come into contact with the dried honeycomb structure is preferably 0.5 mm or more distant from the end of the dried honeycomb structure and is more preferably 1.0 mm or more distant from it, in order to hold the dried honeycomb structure without deforming it. When the position where the claws come into contact with the dried honeycomb structure is less than 0.5 mm distant from the end of the dried honeycomb structure, chipping and so on of the dried honeycomb structure easily occur at the portion near the end of the outer periphery thereof.

Furthermore, it is preferable that the chuck has the claws which can come into contact with the dried honeycomb structure at two or more positions (a plurality of points) distant from each other in the axial direction. According to this configuration, the dried honeycomb structure can be held securely while restricting a vibration thereof.

The present invention may be more fully understood from the description of the preferred embodiments of the invention set forth below, together with the accompanying drawings.

DESCRIPTION OF THE PREFERRED EMBODIMENTS (First Embodiment)

The first embodiment of a method of holding a dried honeycomb structure according to the present invention is described below with reference to FIG. 1 to FIG. 4.

Figure 1:
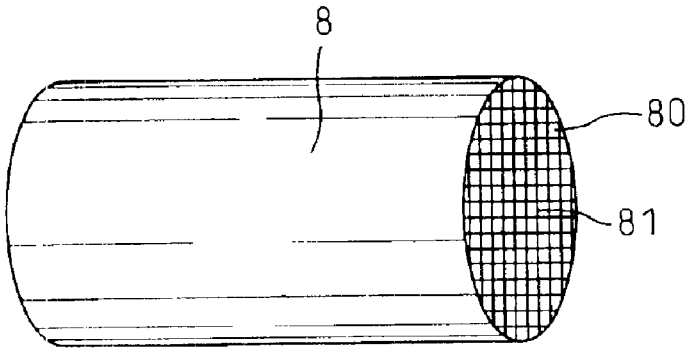
FIG. 1 is a perspective view of the honeycomb structure in a first embodiment of the present invention.

This embodiment is, as shown in FIG. 1, a method of holding a dried honeycomb structure 8, which is a honeycomb structure, after a drying process and before a firing process, when the ceramic honeycomb structure 8 in which bulkheads 81 forming a number of cells 80 are disposed in the form of a honeycomb, is manufactured with a manufacturing method comprising a extruding process, the drying process, and the firing process.

In this embodiment, the dried honeycomb structure 8 must be held two times after the drying process and before the firing process. In the respective holding methods, a chuck 1, 2 having a plurality of claws 10, 20 is used and the plurality of claws 10, 20 are allowed to come into contact with the outer periphery 89 of the dried honeycomb structure 8 so that the direction of the pressure F applied to the dried honeycomb structure 8 by the claws 10, 20 is substantially parallel with the bulkheads 81.

This is described in detail below.

In this embodiment, the raw material, which is made by mixing and kneading ceramic, which will be cordierite after the firing, and a binder is extruded, by a screw type extruder, in the form of honeycomb to provide a honeycomb structure having a length longer than the final length. The honeycomb structure 8 in this embodiment has bulkheads 81, as shown in FIG. 1, which are disposed in the form of a quadrangular lattice so as to constitute quadrangular cells 80. The thickness of the bulkheads 81 of the honeycomb structure 8 in this embodiment is reduced to 100 $\mu$m or less.

Next, performed is the drying process in which the honeycomb structure 8 is left alone, for a certain period, until it dries to obtain the dried honeycomb structure 8. In the drying process, the honeycomb structure 8 may be dried positively by the application of heat, and the dried honeycomb structure 8 becomes very brittle as almost of the moisture contained in the ceramic has evaporated.

Figure 2:
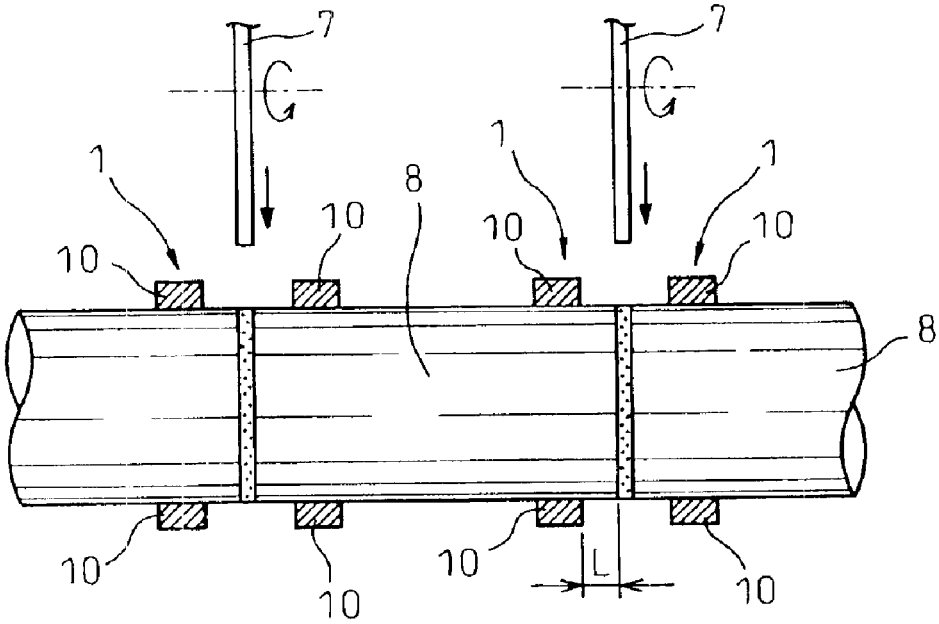
FIG. 2 is a side view of the dried honeycomb structure, in the first embodiment, held by a chuck when it is cut.
Figure 3:
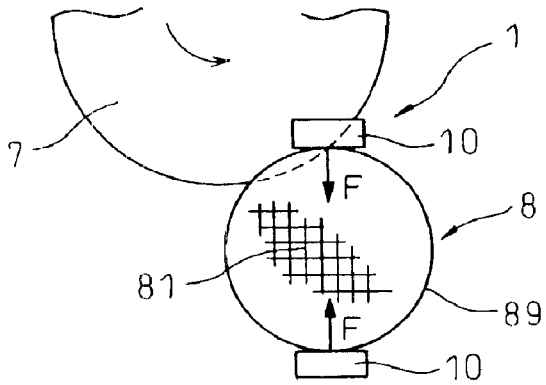
FIG. 3 is a longitudinal front view of the dried honeycomb structure, in the first embodiment, held by a chuck when it is cut.

Then, in this embodiment, as shown in FIG. 2 and FIG. 3, the dried honeycomb structure 8 is cut to a predetermined length. As a method of cutting it, a cutting method, a grinding method, or other various kinds of methods may be applied. In this embodiment, a method of grinding the dried honeycomb structure 8 by rotating and contacting a disc-shaped grinding tool 7 to it is applied. During this cutting, it is necessary to hold the dried honeycomb structure 8 so that it does not move.

In this embodiment, as shown in FIG. 2 and FIG. 3, the dried honeycomb structure 8 is disposed so that the bulkheads 81 are vertically and horizontally oriented under the condition that the axial direction of the dried honeycomb structure 8 is horizontal. This has been adjusted by positioning the metal mold at the extrusion in the former process. Then, the dried honeycomb structure 8 is held by a number of chucks 1 having a pair of upper and lower claws 10 by allowing each of the claws 10 to come into contact with the outer periphery 89 of the dried honeycomb structure 8 at the top and bottom. Consequently, the direction of the pressure F applied to the dried honeycomb structure 8 by the claws 10 becomes substantially parallel with the bulkheads 81, as shown in FIG. 3.

Then, the dried honeycomb structure 8 is cut steadily by holding it at the positions before and behind the cutting position with at least the chuck 1 so that it does not move.

Furthermore, as the distance L, from the position where the claws 10 of the chuck 1 come into contact with the dried honeycomb structure 8 to the end of the dried honeycomb structure 8 after the cutting, is 0.5 mm or more, the claws 10 do not interrupt the cutting during cutting, and occurrence of chipping and so on of the end surface of the dried honeycomb structure 8 is restricted during the cutting.

Furthermore, it is preferable that the chuck 1 has claws 10 which can come into contact with the dried honeycomb structure 8 at two or more positions (a plurality of points) distant from each other in the axial direction. Because of this configuration, the dried honeycomb structure 8 can be held securely while restricting the vibration thereof.

Next, the dried honeycomb structures 8 after the cutting are transferred to a firing furnace in which they are fired. At that time, the orientation of each of the dried honeycomb structures 8 is changed, while keeping the holding state at the cutting, so that its axial direction is vertically oriented. Then, the dried honeycomb structures 8 are held again and transferred with another chuck 2.

Figure 4A:
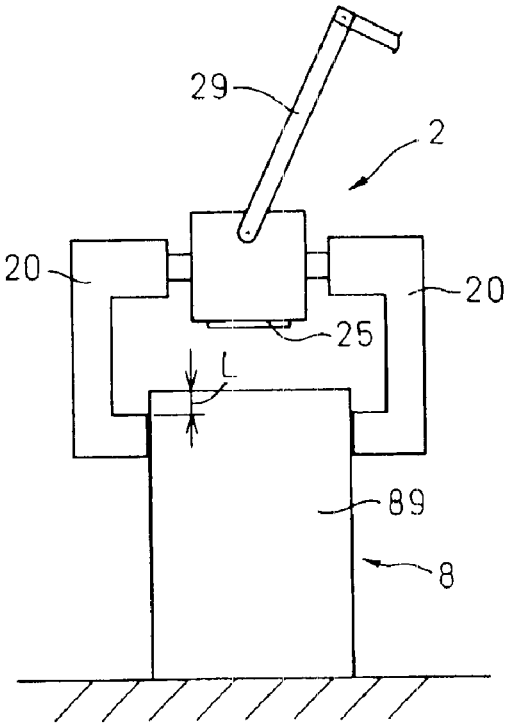
FIG. 4A is a side view of the dried honeycomb structure, in the first embodiment, held by a chuck when it is transferred.
Figure 4B:
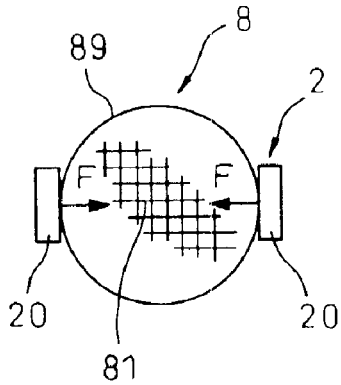
FIG. 4B is a top view of the dried honeycomb structure, in the first embodiment, held by a chuck when it is transferred.

When the dried honeycomb structure 8 is held, the chuck 2 having a pair of right and left claws 20 is used, as shown in FIGS. 4A and 4B. This chuck 2 is equipped with a camera 25 at the center of it, so that the positions of the claws 20 may be changed while visually identifying the directions of the bulkheads 81 of the dried honeycomb structure 8. This chuck 2 is disposed on an arm 29 of a robot for moving the chuck 2. The relative position of the chuck 2 with respect to the dried honeycomb structure 8 is adjusted by moving the chuck 2.

The dried honeycomb structure 8 is held so that the position of the pair of right and left claws 20 is adjusted to match the position of the bulkheads 81, and each of the claws 20 is allowed to come into contact with the dried honeycomb structure 8 at the position the distance L of which from the upper end 88 of the dried honeycomb structure 8 is 0.5 mm or more. Consequently, the direction of the pressure F applied to the dried honeycomb structure 8 by the claws 20 becomes substantially parallel to the bulkheads 81, as shown in FIG. 4B.

Then, the chuck 2 is moved, while keeping this holding state, to transfer the dried honeycomb structure 8 to the next firing process.

Thus, as described above, in this embodiment, the dried honeycomb structure 8 is held both at the cutting of the dried honeycomb structure 8 and the transferring thereof. In both cases, the chuck 1, 2 having a plurality of claws 10, 20 is used and the plurality of claws 10, 20 are allowed to come into contact with the outer periphery 89 of the dried honeycomb structure 8 so that the direction of the pressure F applied to the dried honeycomb structure 8 by the claws 10, 20 is substantially parallel with the bulkheads 81. Consequently, even when the dried honeycomb structure 8, which is very brittle due to its dry state and is further brittle due to the thin bulkheads is held , it is prevented that the bulkheads 81 are chipped and/or crushed.

(Second Embodiment)

In this embodiment, shown in FIGS. 5A to 5E, the shapes and constitutions of the claws applicable to the chuck 1 or 2 in the first embodiment or other chucks, are described.

Figure 5A:
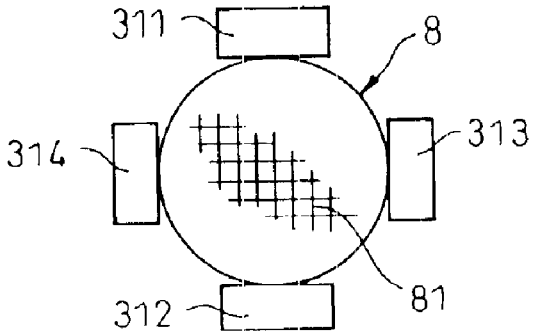
FIG. 5A shows a variation in the constitution of the claws of the chuck in a second embodiment of the present invention.

FIG. 5A shows the constitution of four claws 311 to 314, the right, left, top and bottom claws. In this case, when the cell shape is, for example, quadrangular, the pressures substantially parallel with the bulkheads can be given to the dried honeycomb structure 8 from the right, left, top and bottom directions thereof respectively.

Figure 5B:
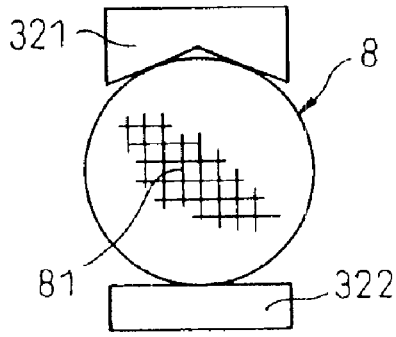
FIG. 5B shows a variation in the constitution of the claws of the chuck in a second embodiment of the present invention.

FIG. 5B shows the constitution of a pair of claws 321 and 322 wherein one of the claws has a plane contact surface and the other one has a V-shaped contact surface. In this case, the dried honeycomb structure 8 can be held securely because of so-called three-point holding. However, the claw 321 having a V-shaped contact surface applies the pressures in two direction to the dried honeycomb structure 8. Therefore, the claws 321 and 322 are so arranged within the range that the pressures in the two directions are in a direction substantially parallel with a direction of the bulkheads 81.

Figure 5C:
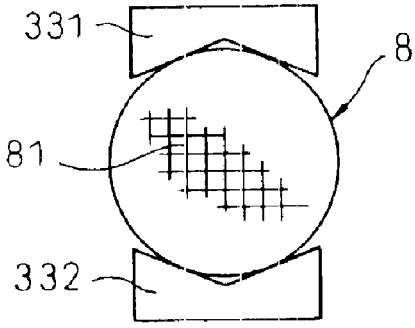
FIG. 5C shows a variation in the constitution of the claws of the chuck in a second embodiment of the present invention.

FIG. 5C shows the constitution of a pair of claws 331 and 332 wherein both of the claws 331, 332 have a V-shaped contact surface. In this case, the dried honeycomb structure 8 can be held securely because of four-point holding. However, each of the claws 331 and 332 applies pressures in two directions to the dried honeycomb structure 8. However, the claws 331 and 332 are so arranged within the range that the pressures in the two directions are in the direction substantially parallel with a direction of the bulkheads 81.

Figure 5D:
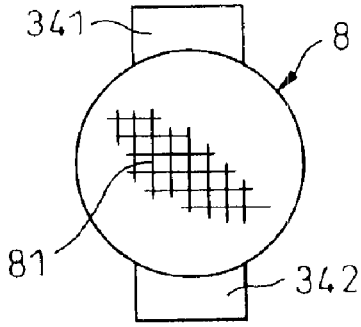
FIG. 5D shows a variation in the constitution of the claws of the chuck in a second embodiment of the present invention.

FIG. 5D shows the constitution of a pair of claws 341 and 342 wherein both of the claws have an arc-shaped contact surface matched with the outline of the dried honeycomb structure 8. In this case, the directions of the pressures applied from various points of the contact surfaces of the claws to the dried honeycomb structure 8 are different, from a microscopic viewpoint, according to the positions of the points. However, the claws 341 and 342 are so arranged within the range that the pressure applied from the various points are in directions substantially parallel with directions of the bulkheads 81. In this case, as the pressures can be distributed over the entire contact surface of the claws, the dried honeycomb structure 8 can be held more securely.

As the materials of the above four kinds of claws, various kinds of materials, for example, rubber such as NBR, metal such as steel or aluminum alloy, or the like, or combination thereof can be used.

Figure 5E:
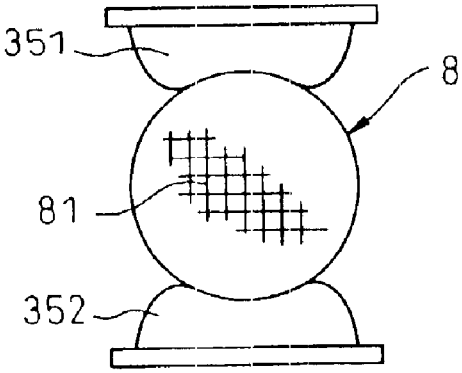
FIG. 5E shows a variation in the constitution of the claws of the chuck in a second embodiment of the present invention.

FIG. 5E shows the constitution of a pair of claws 351 and 352 wherein both of the claws are rubber and have been inflated like balloons so that the contact surfaces thereof are matched with the outline of the dried honeycomb structure 8. Also in this case, the directions of the pressures applied from various points of the contact surfaces of the claws to the dried honeycomb structure 8 are different, from a microscopic viewpoint, according to the positions of the points. However, the claws 351 and 352 are so arranged within the range that the pressures applied from the various points are in the directions substantially parallel with directions of the bulkheads 81. In this case, as the pressures can be distributed over the contact surfaces of these claws very easily because of the flexibility of rubber, the dried honeycomb structure 8 can be held more securely.

(Third Embodiment)

In this embodiment, the bulkheads 81 are disposed so as to constitute quadrangular cells 80 as similar to the first embodiment, and the angle between the bulkhead 81 and the direction of the pressure applied by the claws of the chuck is varied and is examined to find an optimum range.

In order to obtain the optimum range, the following test was concretely conducted. That is, the direction of the pressure F, which is applied to hold the dried honeycomb structure 8 in the condition as shown in FIG. 4B for the first embodiment, was changed, and it was inspected whether the dried honeycomb structure 8 had been chipped and/or crushed.

The result of the test is shown in Table 1. In Table 1, the mark ○ means that damage such as chipping and/or crushing was not observed, and the mark × means that even small damage such as chipping and/or crushing was observed.

As understood from Table 1, when the angle between the pressure F and the bulkheads 81 is in the range of ±35° with reference to the direction parallel with the bulkheads 81, any damage such as chipping and crushing was not observed. From this result, in case that the cell is quadrangular, the condition in which the direction of the pressure applied by the claw is substantially parallel with bulkhead 81 can be in the range of ±35° with reference to the direction parallel with the bulkheads and is more preferably in the range of ±15° with reference to the direction parallel with the bulkheads 81.

TABLE 1

| Incase of quadrangular cell | |
|---|---|
| Angle between pressure F and bulkheads | Judgment |
| ±20° | ○ |
| ±30° | ○ |
| ±35° | ○ |
| ±40° | X |

(Fourth Embodiment)

In this embodiment, the bulkheads 81 are disposed so as to constitute hexagonal cells 80, and the angle between the bulkheads 81 and the direction of the pressure applied by the claws of the chuck is varied and is examined to find an optimum range.

Figure 6:
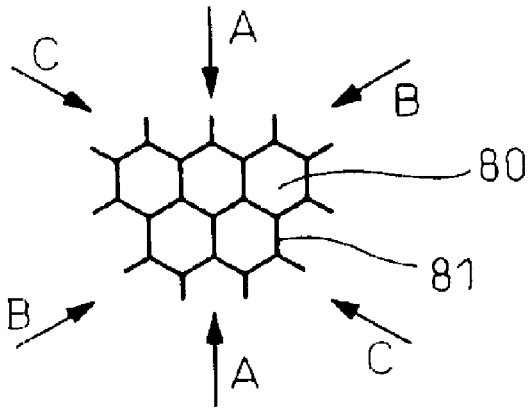
FIG. 6 shows the geometry of the bulkheads of the honeycomb structure in a fourth embodiment of the present invention.

When the cell 80 is hexagonal as shown in FIG. 6, there are three directions shown with the arrows A, B, and C and parallel with the bulkheads 81. The dried honeycomb structure 8 may be held in any of these directions. In order to obtain the optimum range, in this embodiment the following test was conducted. That is, the angle between the direction of the pressure F and any one of the directions (the arrows A, B, and C) parallel with the bulkheads 81 was changed, and it was inspected whether the dried honeycomb structure 8 had been chipped and/or crushed.

The specific test method and evaluation method are the same as the third embodiment.

The result of the test is shown in Table 2.

As understood from Table 2, when the angle between the pressure F and the bulkheads 81 is in the range of ±25° with reference to the direction parallel with the bulkheads 81, any damage such as chipping and crushing was not observed. From this result, in case that the cell is hexagonal, the condition in which the direction of the pressure applied by the claw is substantially parallel with bulkhead 81 can be in the range of ±20 with reference to the direction parallel with the bulkheads 81 and is more preferably in the range of ±10° with reference to the direction parallel with the bulkheads 81.

TABLE 2

| Incase of hexagonal cell | |
|---|---|
| Angle between pressure F and bulkheads | Judgment |
| ±10° | ○ |
| ±15° | ○ |
| ±20° | ○ |
| ±25° | X |

(Fifth Embodiment)

In this embodiment, the bulkheads 81 are disposed so as to constitute triangular cells 80, and the angle between the bulkheads 81 and the direction of the pressure applied by the claws of the chuck is varied and is examined to find an optimum range.

Figure 7:
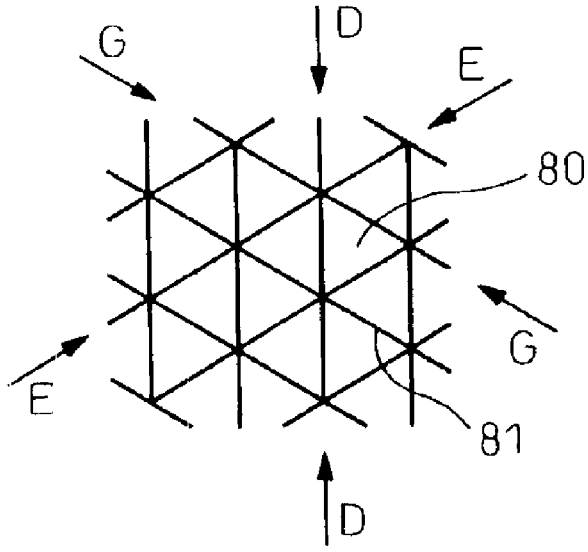
FIG. 7 shows the geometry of the bulkheads of the honeycomb structure in a fifth embodiment of the present invention.

When the cell 80 is triangular as shown in FIG. 7, there are three directions shown with the arrows D, E, and G and parallel with the bulkheads 81. The dried honeycomb structure 8 may be held in any of these directions. In order to obtain the optimum range, in this embodiment the following test was conducted. That is, the angle between the direction of the pressure F and any one of the directions (the arrows A, B, and C) parallel with the bulkheads 81 was changed, and it was inspected whether the dried honeycomb structure 8 had been chipped and/or crushed.

The specific test method and evaluation method are the same as the third embodiment.

The result of the test is shown in Table 3.

As understood from Table 3, when the angle between the pressure F and the bulkheads 81 is in the range of ±20° with reference to the direction parallel with the bulkheads 81, any damage such as chipping and crushing was not observed. From this result, in case that the cell is triangular, the condition in which the direction of the pressure applied by the claw is substantially parallel with bulkhead 81 can be in the range of ±20° with reference to the direction parallel with the bulkheads 81 and is more preferably in the range of ±10° with reference to the direction parallel with the bulkheads 81.

TABLE 3

| Incase of triangular cell | |
|---|---|
| Angle between pressure F and bulkheads | Judgment |
| ±10° | ○ |
| ±15° | ○ |
| ±20° | ○ |
| ±25° | X |

(Sixth Embodiment)

In this embodiment, various kinds of outer shape, that is, the shape of the outer periphery 89, of the dried honeycomb structure 8, to which a holding method according to the present invention can be applied, are exemplified.

Figure 8A:
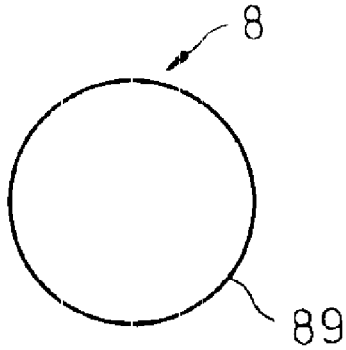
FIG. 8A shows a variation of the outside shape of the dried honeycomb structure applicable to the holding method according to a sixth embodiment of the present invention.

The dried honeycomb structure 8 shown in FIG. 8A has a circular outer shape like the first embodiment.

Figure 8B:
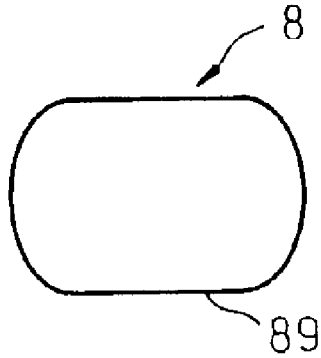
FIG. 8B shows a variation of the outside shape of the dried honeycomb structure applicable to the holding method according to a sixth embodiment of the present invention.

The dried honeycomb structure 8 shown in FIG. 8B has a so-called race track outer shape, that is, an outer shape of a combination of straight lines and curves.

Figure 8C:
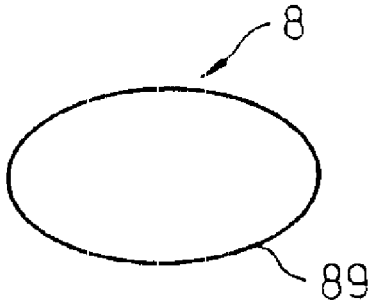
FIG. 8C shows a variation of the outside shape of the dried honeycomb structure applicable to the holding method according to a sixth embodiment of the present invention.

The dried honeycomb structure 8 shown in FIG. 8C has an elliptical outer shape.

Figure 8D:
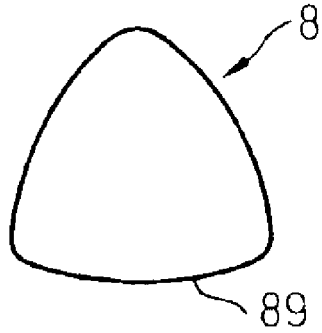
FIG. 8D shows a variation of the outside shape of the dried honeycomb structure applicable to the holding method according to a sixth embodiment of the present invention.

The dried honeycomb structure 8 shown in FIG. 8D has a rounded triangular outer shape.

Figure 8E:
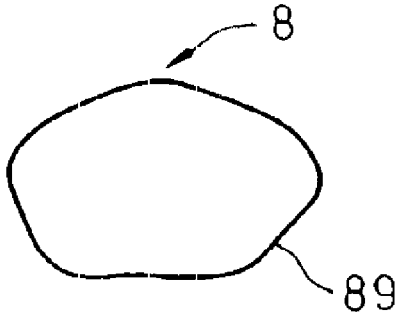
FIG. 8E shows a variation of the outside shape of the dried honeycomb structure applicable to the holding method according to a sixth embodiment of the present invention.

The dried honeycomb structure 8 shown in FIG. 8E has an indefinite outer shape.

In any outer shape, like the first embodiment, the chuck having a plurality of claws is used and the plurality of claws are allowed to come into contact with the outer periphery 89 of the dried honeycomb structure 8 so that the direction of the pressure applied to the dried honeycomb structure 8 by the claws is substantially parallel with the bulkheads 81, and thereby it can be prevented that the dried honeycomb structure 8 are chipped and/or crushed.

While the invention has been described by reference to specific embodiments chosen for the purposes of illustration, it should be apparent that numerous modifications could be made thereto by those skilled in the art without departing from the basic concept and scope of the invention.

What is claimed:

1. A method of holding a dried honeycomb structure, which is a honeycomb structure after a drying process and before a firing process, when a ceramic honeycomb structure in which bulkheads forming a number of cells are disposed in the form of a honeycomb is manufactured with a manufacturing method comprising an extruding process, said drying process, and said firing process;

wherein a chuck having a plurality of claws is used and the plurality of claws are allowed to come into contact with an outer periphery of said dried honeycomb structure so that the direction of the pressure applied to said dried honeycomb structure by said claws is substantially parallel with said bulkheads.

2. The method of holding a dried honeycomb structure of claim 1, wherein said bulkheads are disposed so as to constitute the cells having a quadrangular shape, and the angle between said bulkheads and the direction of the pressure applied by said claws is in the range of ±35° with reference to the direction parallel with said bulkheads.

3. The method of holding a dried honeycomb structure of claim 2, wherein said bulkheads are disposed so as to constitute the cells having a quadrangular shape, and the angle between said bulkheads and the direction of the pressure applied by said claws is preferably in the range of ±15° with reference to the direction parallel with said bulkheads.

4. The method of holding a dried honeycomb structure of claim 1, wherein said bulkheads are disposed so as to constitute the cells having a hexagonal shape, and the angle between said bulkheads and the direction of the pressure applied by said claws is in the range of ±20° with reference to the direction parallel with said bulkheads.

5. The method of holding a dried honeycomb structure of claim 4, wherein said bulkheads are disposed so as to constitute the cells having a hexagonal shape, and the angle between said bulkheads and the direction of the pressure applied by said claws is preferably in the range of ±10° with reference to the direction parallel with said bulkheads.

6. The method of holding a dried honeycomb structure of claim 1, wherein said bulkheads are disposed so as to constitute the cells having a triangular shape, and the angle between said bulkheads and the direction of the pressure applied by said claws is in the range of ±20° with reference to the direction parallel with said bulkheads.

7. The method of holding a dried honeycomb structure of claim 6, wherein said bulkheads are disposed so as to constitute the cells having a triangular shape, and the angle between said bulkheads and the direction of the pressure applied by said claws is preferably in the range of ±10° with reference to the direction parallel with said bulkheads.

8. The method of holding a dried honeycomb structure of claim 1, wherein the thickness of said bulkheads is 150 $\mu$m or less.

9. The method of holding a dried honeycomb structure of claim 8, wherein the thickness of said bulkheads is preferably 100 $\mu$m or less.

10. The method of holding a dried honeycomb structure of claim 1, wherein said chuck is disposed on an arm of a robot for moving said chuck, and the relative position of said chuck with respect to said dried honeycomb structure is adjusted by moving said chuck.

11. The method of holding a dried honeycomb structure of claim 1, wherein the relative position of said chuck with respect to said dried honeycomb structure is adjusted by moving said dried honeycomb structure.

12. The method of holding a dried honeycomb structure of claim 1, wherein the position where said claws come into contact with the dried honeycomb structure is 0.5 mm or more distant from the end of said dried honeycomb structure in order to hold said dried honeycomb structure without deformation thereof.

13. The method of holding a dried honeycomb structure of claim 12, wherein the position where said claws come into contact with the dried honeycomb structure is 1.0 mm or more distant from the end of said dried honeycomb structure in order to hold said dried honeycomb structure without deformation thereof.

14. The method of holding a dried honeycomb structure of claim 1, wherein said chuck has said claws which can come into contact with the dried honeycomb structure at two or more positions in an axial direction of said honeycomb structure.

* * * * *